United States Patent [19]

Simonsen

[11] Patent Number: 4,613,085

[45] Date of Patent: Sep. 23, 1986

[54] COMMINUTING MACHINE WITH FEED WORM, ESPECIALLY FOR COMMINUTING FROZEN MEAT

[76] Inventor: Knud Simonsen, Strudsbergsvej 44, 4200 Slagelse, Denmark

[21] Appl. No.: 641,338

[22] Filed: Aug. 16, 1984

[30] Foreign Application Priority Data

Aug. 17, 1983 [DK] Denmark ..... 3760/83

[51] Int. Cl.[4] ..... B02C 18/30

[52] U.S. Cl. ..... 241/82.5; 241/247; 241/260.1

[58] Field of Search ..... 241/260.1, 82.1–82.7, 241/186 A, 246, 247

[56] References Cited

U.S. PATENT DOCUMENTS

| | | | |
|---|---|---|---|
| 984,406 | 2/1911 | Wiestner | 241/260.1 |
| 2,216,023 | 9/1940 | Schmidt . | |
| 2,282,521 | 5/1942 | Kaptuller | 241/82.6 |
| 2,796,901 | 6/1957 | Autio . | |
| 3,213,911 | 10/1965 | Seydelmann . | |
| 3,380,503 | 4/1968 | Rees | 241/82.5 |

FOREIGN PATENT DOCUMENTS

| | | | |
|---|---|---|---|
| 125313 | 2/1973 | Denmark . | |
| 343287 | 10/1921 | Fed. Rep. of Germany | 241/82.5 |
| 557643 | 8/1932 | Fed. Rep. of Germany . | |
| 676606 | 6/1939 | Fed. Rep. of Germany | 241/82.1 |

*Primary Examiner*—Mark Rosenbaum

*Attorney, Agent, or Firm*—Fleit, Jacobson, Cohn & Price

[57] ABSTRACT

A feed worm located at the bottom of an infeeding hopper is shaped in the form of at least one convolution or turn, without a central core or shaft. The sharp edge or knife edge of the feed worm lying forwardmost in the direction of rotation attacks a block of frozen meat at a location higher than by using previously known feed worms having a central shaft and core. The central shaft or core prevents the frozen block from moving in the downward direction as far as is possible with a feed worm devoid of a core or central shaft. The feed worm includes a thick-walled tube of steel in which over one-half of the tube has been cut away along helical surfaces forming sharp edges with the outside surface of the tube.

9 Claims, 2 Drawing Figures

Figure 1:
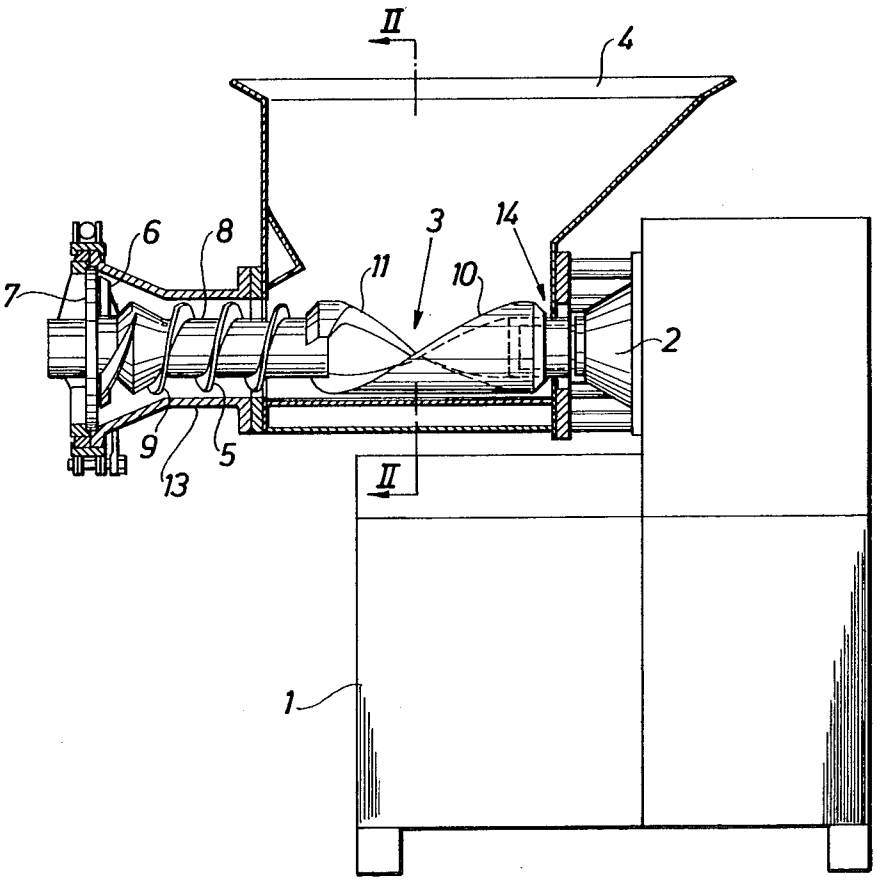

II
4
2
14
10
3
11
8
6
7
5
13
9
II
1

4
12
11
10

COMMINUTING MACHINE WITH FEED WORM, ESPECIALLY FOR COMMINUTING FROZEN MEAT

The present invention relates to a comminuting machine with a feed worm, especially for cutting-up blocks of frozen meat, of the kind comprising (a) an infeeding hopper, (b) a feed worm placed adjacent the bottom of said infeeding hopper and adapted to engage pieces of the material placed in the infeeding hopper and convey same to a comminuting mechanism, and (c) possibly a delivery worm placed between said feed worm and said comminuting mechansim.

In known comminuting machines of this kind, the feed worm is shaped in the conventional manner in the form of a thick shaft or core with one or a number of worm convolutions or turns placed around same in the shape of a helix. When a machine with such a feed worm is used for cutting-up a frozen block of meat placed in the infeeding hopper, this block of meat can at the most move so far in the downward direction that its bottom surface abuts against the top of the central shaft or core of the feed worm. The result of this is that the convolutions of the worm at the most can attack the block on a level at a distance from the bottom side of the block corresponding to the radial height of the worm convolutions. To enable the worm convolutions to tear off parts of the frozen block of meat it is therefore necessary that these convolutions have a not inconsiderable radial height. This, however, results in the total diameter of the feed worm being correspondingly great and that a not inconsiderable turning moment is required to rotate the feed worm, resulting again in a corresponding load on the machine's drive mechansim.

The present invention, the purpose of which is to remedy the disadvantages mentioned above, is based on the surprising realization that the central core or shaft of the feed worm as known hitherto is not absolutely necessary, provided that the feed worm in other respects can be shaped in such a manner that it can transmit the forces involved.

Thus, the comminuting machine according to the invention is characterized in that the feed worm consists of one or a number of worm convolutions without a central core or shaft. This provides for the removal of the obstruction constituted by the center core or shaft in the previously known feed worms, and for this reason it is possible for the edge of the feed worm lying radially outward and forward in the direction of rotation—said edge to this purpose possibly being formed as a sharp cutting edge—to attack the block of meat at a higher level than would otherwise be possible.

The embodiment of the machine preferred in practice is characterized in that the feed worm consists of a single worm convolution in the form of a thick-walled tube, of which at least one-half of the cross-sectional area is cut away so as to form a surface facing forward in the direction of rotation and a surface facing rearward in said direction of rotation, said surfaces extending substantially in a helical manner relative to the axis of rotation of the feed worm. The result of this arrangement is partly that the feed worm is relatively easy to manufacture, since it may be made from a piece of commerically available precision tubular steel stock, partly that it will have the requisite strength to transmit the force from the machine's drive mechansim to the material to be comminuted by (inter alia) the feed worm, possibly also to a subsequent delivery worm placed between the feed worm and the comminuting mechanism placed downstream thereof.

A further embodiment of the machine according to the invention is characterized in that the surface on each worm convolution facing forward in the direction of rotation forms a sharp edge or knife edge with the radially outward facing surface on each worm convolution, said sharp edge being the edge, with which the feed worm attacks the material in the infeeding hopper.

Still another embodiment is characterized in that the surface on each worm convolution facing opposite the direction of rotation also forms a sharp edge or knife edge with the radially outward facing surface on each worm convolution. This arrangement makes it easier to loosen any obstructions by turning the feed worm in the reverse direction—i.e. opposite the normal direction of rotation—than would be possible if there was no sharp edge on this part of the feed worm.

If the machine according to the invention is of the otherwise known kind comprising a delivery worm surrounded by a housing between said feed worm and said comminuting mechanism, then the possibility of reducing the diameter of the feed worm made possible by the present invention may be exploited in an advantageous manner in an embodiment, wherein the external diameter of said feed worm is at the most equal to and preferably less than the internal diameter of said housing. This make it possible—e.g. for cleaning purposes—to remove the feed worm through the housing of the delivery worm, which possibility may in many cases entail a considerable simplification of the machine.

Figure 2:
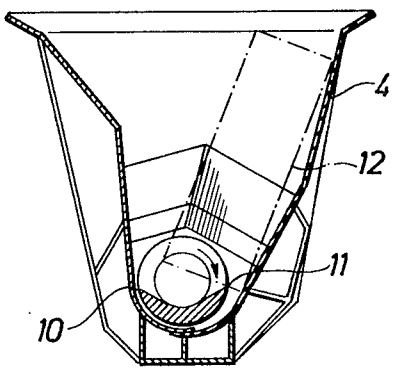

The present invention will be explained below in a more detailed manner with reference to the drawings, showing an example of a meat comminuting machine according to the present invention, FIG. 1 showing the machine in elevation and partly in section, and FIG. 2 being a cross-section following the line II—II in FIG. 1, further showing the outline of a frozen block of meat to be comminuted in the machine.

The comminuting machine shown on the drawing comprises in a known manner a machine cabinent 1 containing a drive motor with associated control means (not shown). The drive motor is adapted to drive a gear box 2, of which only the portion protruding from the cabinet 1 is visible in FIG. 1. The output shaft of the gear box 2 is directly connected to a first worm or feed worm 3 placed in the channel-shaped bottom region of an infeeding hopper 4. the opposte end of the feed worm 3 is connected, e.g. by welding, to a second worm or delivery worm 5 adapted in a known manner to deliver pieces of meat received from the first worm or feed worm 3 to a comminuting mechanism consisting of a rotating knife set 6 and a perforated disk 7 cooperating therewith.

As can be seen from FIG. 1 the second worm or delivery worm 5 consisting of a worm core 8 with one or a number of worm convolutions 9 secured to or formed integral with the core 8. In previously known machines of a similar kind the first worm or feed worm also consists of a core with one or a number of convolutions placed or formed around it. In contradistinction to said previously known arrangement the first worm or feed worm 3 according to the present invention consists solely of a single convolution, in the example shown consisting of a piece of thick-walled tubular steel stock, from which well over one-half has been removed between generally rectilinear generatrices extending in radial planes between generally helical edge lines on the outside and inside of the tubular stock, so that the radial cross-section of the worm convolution thus produced takes the form shown in FIG. 2. At the outer edge 10 pointing forwardly in the direction of rotation the generatrices extend radially inwardly and opposite to the direction of rotation, so that this forward edge 10 constitutes a sharp knife edge, which during rotation can cut a block of meat 12 indicated in phantom lines in FIG. 2 in pieces. In the example shown in the rearward edge 11 is also formed as a sharp knife edge; this can be useful when the machine is driven in reverse, such as for the purpose of removing an obstruction. Otherwise, the surface on the worm 3 facing against the direction of rotation and extending radially inwardly from the rearward edge 11 may also have a different orientation from the one shown, e.g. in a radial direction.

Practical experience has shown that for the edge lying forwardmost in the direction of rotation, i.e. the edge 10, to be able to loosen pieces from a frozen block of meat, it is necessary that this edge hits the block of meat at a certain minimum height distance from the lowermost part of the block. In previously known machines of this kind in which the first worm or feed worm was shaped in a similar manner to the second worm or delivery worm 5, i.e. in the form of a core or shaft with a worm convolution placed around it, this condition could only be satisfied by shaping the convolutions with a certain radial height as measured from the surface of the core or shaft, as the lowermost part of the block of meat would ride on the core or shaft, the latter thus preventing the block of meat from moving further in the downward direction. This obstruction no longer exists in the feed worm according to the present invention, as the core or shaft has simply been removed and the tangential width of the worm convolution increased so as to give it sufficient strength to transmit the driving force from the gear box 2, partly to the material being worked on by the feed worm itself, partly to the second worm of delivery worm 5.

Because the feed worm according to the present invention does not have that core or shaft which in the previously known machines constitutes a stop for the downward movement of the blocks of meat, it is possible which retaining the same ability to engage the blocks of meat to give this feed worm a substantially smaller outside diameter than the conventional feed worms. As an example, it can be mentioned that in a machine, in which the conventionally shaped feed worm had an outside diameter of approximately 330 mm, it is possible to use a feed worm according to the invention with a substantially smaller outside diameter, right down to approximately 230 mm, with the same results. Assuming that in both cases approximately the same tangential force is required to act on the blocks of meat, then this decrease in diameter will result in a corresponding decrease in the load on the gear box 2 and its drive motor (not shown).

A further advantage gained by the decrease in the diameter of the feed worm is that in many cases, e.g. for the purpose of cleaning, the feed worm may be removed from the machine through the housing surrounding the second worm or delivery worm—in the example shown the housing 13 surrounding the delivery worm 5. For this purpose, the perforated disk 7 can in an otherwise known manner be adapted to be removed from the end of the housing 13, and the end of the feed worm 3 lying to the right in FIG. 1 be connected to the output shaft of the gear box 2 by means of a plug-in coupling 14 indicated in phantom lines in FIG. 1.

I claim:

1. A mechansim for cutting-up blocks of frozen meat, said mechansim comprising:

a feed hopper, and a cutting feed worm located adjacent to a bottom of said feed hopper for cutting up blocks of frozen material during rotation of said cutting feed worm, said cutting feed worm including two ends, said two ends being supported to transmit a driving force from one end of said cutting feed worm to the other end of said cutting feed worm sufficient to cut frozen blocks of material, said cutting feed worm including a coreless single worm convolution an innermost surface of said single worm convolution defining an arcuate surface spaced a constant radial distance from an axis of rotation of said single worm convolution throughout its length formed by cutting away at least one-half of the cross-sectional area of said single worm convolution, said thick-walled tube defining a surface facing forward in a direction of rotation of said single worm convolution for cutting a lowermost portion of a block of frozen material which has been lowered into said hopper and defining a surface facing rearward in said direction of rotation of said single worm convolution, said surface facing forward and said surface facing rearward extending substantially in a helical manner relative to said axis of rotation of said single worm convolution.

2. A machine according to claim 1, wherein said surface facing forward in said direction of rotation includes a knife edge at its radially outward edge and an angle defined between said knife edge and a planar portion of said surface facing forward is an acute angle of the order of magnitude of 45°.

3. A machine according to claim 2, wherein said surface facing rearward in said direction of rotation also forms a knife edge at its radially outward edge.

4. A comminuting machine comprising:

a feed hopper;

a cutting feed worm located adjacent to a bottom of said feed hopper for cutting up blocks of frozen material and for conveying the cut-up blocks during rotation of said cutting feed worm, said cutting feed worm including two ends, said two ends being supported to transmit a driving force from one end of said cutting feed worm to the other end of said cutting feed worm sufficient to cut frozen blocks of material, said cutting feed worm including a coreless single worm convolution formed by cutting away at least one-half of the cross-sectional area of a thick-walled tube, an innermost surface of said single worm convolution defining an arcuate surface spaced a constant radial distance from an axis of rotation of said single work convolution throughout its length said single worm convolution defining a surface facing forward in a direction of rotation of said single worm convolution for cutting a lowermost portion of a block of frozen material which has been lowered into said hopper and defining a surface facing rearward in said direction of rotation of said single worm convolution, said surface facing forward and said surface facing rearward extending substantially in a helical manner relative to said axis of rotation of said single worm convolution, drive means for rotating said cutting feed worm, and comminuting means located downstream from said cutting feed worm for comminuting the cut-up material conveyed by said cutting feed worm.

5. A machine according to claim 4, wherein said surface facing forward in said direction of rotation includes a knife edge at its radially outward edge and an angle defined between said knife edge and a plannar portion of said surface facing forward is an acute angle of the order of magnitude of 45°.

6. A machine according to claim 5, wherein said surface facing rearward in said direction of rotation also forms a knife edge at its radially outward edge.

7. A comminuting machine comprising:

a feed hopper;

a cutting feed worm located adjacent to a bottom of said feed hopper for cutting up blocks of frozen material and for conveying the cut-up blocks during rotation of said cutting feed worm, said cutting feed worm including two ends, said two ends being supported to transmit a driving force from one end of said cutting feed worm to the other end of said cutting feed worm sufficient to cut frozen blocks of material, said cutting feed worm including a coreless single worm convolution formed by cutting away at least one-half of the cross-sectional area of a thick-walled tube, an innermost surface of said single worm convolution defining an arcuate surface spaced a constant radial distance from an axis of rotation of said single worm convolution throughout its length said single worm convolution defining a surface facing forward in a direction of rotation of said single worm convolution for cutting a lowermost portion of a block of frozen material which has been lowered into said hopper and defining a surface facing rearward in said direction of rotation of said single worm convolution, said surface facing forward and said surface facing rearward extending substantially in a helical manner relative to said axis of rotation of said single worm convolution, drive means for rotating said one end of said cutting feed worm, a delivery worm secured to said other end of said cutting feed worm for conveying the material cut-up by said feed worm, and comminuting means located downstream from said delivery worm for comminuting the cut-up material conveying by said delivery worm.

8. A machine according to claim 7, wherein said surface facing forward in said direction of rotation includes a knife edge at its radially outward edge and an angle defined between said knife edge and a planar portion of said surface facing forward is an acute angle of the order of magnitude of 45°.

9. A machine according to claim 6, wherein said surface facing rearward in said direction of rotation also forms a knife edge at its radially outward edge.

* * * * *